US006133207A

United States Patent [19]

Milner et al.

[11] Patent Number: 6,133,207

[45] Date of Patent: Oct. 17, 2000

[54] ODOR REDUCTION OF LUBRICANT ADDITIVES PACKAGES

[75] Inventors: Jeffrey Lynn Milner, Midlothian; Ronald Lee Phillips, Richmond; Nubar Ozbalik; Anthony J. Rollin, both of Midlothian, all of Va.

[73] Assignee: Ethyl Corporation, Va.

[21] Appl. No.: 09/469,381

[22] Filed: Dec. 22, 1999

[51] Int. Cl.[7] ..... C10M 137/08

[52] U.S. Cl. ..... 508/436; 508/436

[58] Field of Search ..... 508/436, 438

[56] References Cited

U.S. PATENT DOCUMENTS

| | | | |
|---|---|---|---|
| 3,826,798 | 7/1974 | Udelhofen et al. | 260/139 |
| 3,966,622 | 6/1976 | Hellmuth et al. | 252/46.6 |
| 4,431,552 | 2/1984 | Salentine | 508/436 |
| 5,246,605 | 9/1993 | Vartanian | 508/436 |
| 5,338,468 | 8/1994 | Arvizzigno et al. | 252/45 |
| 5,403,961 | 4/1995 | Shaw | 568/21 |
| 5,700,764 | 12/1997 | Walters et al. | 508/338 |
| 5,942,470 | 8/1999 | Norman et al. | 508/436 |

FOREIGN PATENT DOCUMENTS 076376 4/1983 European Pat. Off. .

*Primary Examiner*—Jacqueline V. Howard
*Attorney, Agent, or Firm*—Dennis H. Rainear; Thomas Hamiton

[57] ABSTRACT

Sulfurized phosphorous compounds, which are effective anti-wear, extreme pressure agents, may be formed without odor by reacting phosphorous compounds with other reactive sulfur sources, including elemental sulfur, before addition of polysulfides. The process of the present invention yields a lubricant additive package which is odor free or very low odor, thermally stable, and which contains polysulfides. Particularly useful embodiments of this invention include low odor gear lubricant additive packages.

19 Claims, No Drawings

ODOR REDUCTION OF LUBRICANT ADDITIVES PACKAGES

TECHNICAL FIELD

Non-engine lubricants are used to lubricate equipment that operates in a non-combustion environment. They are used for mechanisms that transfer power from a power source to parts that perform the actual work. Gear oils, greases, transmission fluids (such as power steering fluid and shock absorber fluids) and hydraulic fluids are examples of non-engine lubricants.

Gear oils are formulated to provide both gears and axles with extreme-pressure protection against fatigue, scoring and wear. As the requirements of equipment builders have begun to exceed the API specifications currently used for gear lubricants, it has become increasingly important to supply specially formulated gear packages that excel in the area of extreme pressure and anti-wear protection.

Wear is the loss of metal between surfaces moving relative to each other. Wear occurs in all equipment that have moving parts. If wear continues it leads to equipment malfunction. Among the principal factors causing wear are metal-to-metal contact (frictional wear), presence of abrasive particulate matter (abrasive wear), and attack of corrosive acids (corrosive wear). Contaminant control is not as difficult in gear lubricants because there are no fuel degradation products. Metal-to-metal contact (frictional wear) may be prevented by adding film-forming compounds that protect the surface by physical absorption or chemical reaction. Effective additives that are used for anti-wear additives contain phosphorous, sulfur, or combinations of these elements.

The functions of a gear lubricant are essentially the same as those for all lubricants with an increased emphasis on friction reduction, extreme pressure protection and heat removal.

BACKGROUND OF THE INVENTION

Dibutyl hydrogen thiophosphate amine salt is an anti-wear product that has been produced by Ethyl Corporation for use in crankcase products. This product is also prepared for gear packages by the in-situ reaction of dibutyl hydrogen phosphite (DBHP), sulfurized isobutylene (SIB) and an amine to form the thiophosphate amine salt. To improve the thermal stability of gear lubricant packages, tertiary-butyl polysulfide (an extreme pressure additive) has been substituted for sulfurized isobutylene. When the above reaction takes place in the presence of t-butyl polysulfide, a strong mercaptan odor is generated in the final product that is attributable to the reduction of unstable sulfur—sulfur bonds in the polysulfide. A low odor, thermally stable formulation for gear packages that contains polysulfides would be an advancement in the art.

BACKGROUND ART

U.S. Pat. No. 5,338,468 to Arvizzigno et al. discloses a procedure for the production of sulfurized olefins by reacting elemental sulfur with olefins in an aqueous solution of a strong base to obtain sulfurized olefins with non-staining, low odor properties. This patent does not teach the presulfurization of a phosphite anti-wear product before the addition of the polysulfide, extreme pressure agent to eliminate the strong mercaptan odor.

Hellmuth et al. has been granted U.S. Pat. No. 3,966,622 for the method of preparing a lubricating oil concentrate of a detergent-dispersant sulfurized alkoxylated product. The improvement in this patent comprises a step in which the alkoxylated inorganic free, steam hydrolyzed polyalkene-$P_2S_5$ reaction product is reacted with elemental sulfur to form the sulfurized alkoxylated product and then contacting this product with an alkylene oxide under certain perscribed conditions. This patent requires the absorption of alkylene oxide in a process that can take from one to ten hours for the absorption to cease.

U.S. Pat. No. 3,826,798 to Udelhofen et al. reveals another method that has been attempted to eliminate the odor for crankcase lubricants. This patent teaches the addition of 2,5-bis (alkyldithio)-1,3,4-thiadiazole to a phosphosulfurized hydrocarbon polymer to suppress the odor and the release of $H_2S$.

EP 076,376 to Pennwalt Corporation discloses a method for improving the odor of dialkyl polysulfides whereby the polysulfides are mixed with a metal salt. The reference process is lengthy and preferably uses an expensive anhydrous salt.

Shaw in U.S. Pat. No. 5,403,961 teaches a process for preparing a stabilized and deodorized organic polysulfide compound which involves contacting the polysulfide with a metal salt of an organic or inorganic acid. The Shaw patent is an improvement of EP 076,376 cited above in that it requires less salt and thus, less expense. It does not solve the odor problem without the introduction of metal salts, which can lead to ash deposits.

SUMMARY OF THE INVENTION

The present invention comprises a process for reducing the odor associated with the additives necessary in lubricant packages in general, and gear lubricant packages in particular. The present invention focuses on odor reduction in lubricant packages while still providing for the presence of anti-wear and extreme pressure additives. This is achieved according to the present invention by presulfurizing a mixture or reaction product of an oxidizable phosphorus compound and an alkylamine. Improved manufacturing conditions and consumer acceptance of low odor gear packages containing the desirable additives for anti-wear and extreme pressure, are advantages of the formulation procedure outlined in the present invention.

An odoriferous product is obtained when certain phosphorous compounds react with polysulfides having reactive sulfur-sulfur bonds. Pre-reacting an oxidizable phosphorous compound with one or more reactive sulfur compounds, including, for example and not as a limitation, elemental sulfur or sulfurized olefin, before addition of polysulfides or other compounds otherwise able to generate odor, according to the present invention reduces or eliminates odor in the final lubricant additive product. By "reactive sulfur" herein is meant any sulfur with an oxidation state or oxidation number of 0 or −1. By "oxidizable phosphorus" herein is meant a phosphorus-containing material wherein the phosphorus can be and is by the present invention oxidized by reaction with reactive sulfur.

Many countries have required the use of lubricant additives that meet their environmental concern yet additives that are thermally stable. The present invention meets those needs by providing a method for producing a thermally stable additive that eliminates the strong odor previously associated with such production. The discovery of this route to odor control has benefits during additive package manufacturing. Many times, manufacturing plants are located near residential areas and release of odor generates concerns in the local population. The impact can be serious for the manufacturer and even include orders by the EPA to cease manufacturing. Once such a directive is received, it becomes difficult for a manufacturer to resume operations without economic investment. Likely solutions include significant capital investment in equipment designed to control even minute levels of emissions or transfer of the process to a tolling manufacturer where significantly higher unit manufacturing costs are incurred.

The present invention allows for control of odors during manufacturing as well as during compounding into finished gear lubricants. Risk of odor release from the more thermally stable polysulfide extreme pressure agent is greatly reduced during all steps of the supply chain including manufacturing, handling, compounding, and end-use.

This process will allow a company to produce a low odor lubricant additive that contains an oxidizable phosphorus anti-wear compound and a polysulfide extreme pressure additive. These advantages include low chlorine and thermal stability with extreme pressure performance.

Thus, the present invention in one embodiment is directed to a process for preparing a lubricant additive of reduced odor, the process comprising first combining an oxidizable phosphorus compound and an alkylamine with a source of reactive sulfur whereby the oxidizable phosphorus compound is at least partially oxidized, followed by the addition of a compound that liberates odor if combined with an oxidizable phosphorus compound.

The invention further relates to a lubricant comprising the reduced-odor additive.

DETAILED DESCRIPTION OF THE PREFERRED EMBODIMENT(S)

According to the present invention, an oxidizable phosphorus compound that has been reacted, commingled, contacted or mixed with an alkyl amine is pre-sulfurized with elemental sulfur or by using another reactive sulfur compound, like sulfurized isobutylene (SIB). After this mixing and/or reaction has occurred, a polysulfide or other active sulfur compound is added. The polysulfide may be, for example, but without limitation, t-butyl polysulfide, dialkyl polysulfide, diaryl polysulfide, or mixtures thereof. The alkylamine can be a primary, secondary or tertiary alkylamine. Preferred alkyl amines include $C_8$–$C_{30}$ alkyl amines, more preferably $C_{16}$–$C_{18}$ alkyl amines, and a tertiary aliphatic primary amine, or a salt thereof.

Thus, in one embodiment the present invention is directed to a process for preparing a gear lubricant additive of reduced odor, the process comprising first combining an oxidizable phosphorus compound and an alkylamine with a pre-sulfurized source of sulfur followed by the addition of a polysulfide. Preferred sulfur sources for the presulfurization can include, for example, sulfurized olefins such as sulfurized isobutylene, and elemental sulfur. The additive is useful in preparing low-odor fully formulated lubricants which comprise natural and/or synthetic oil, plus conventional pressure and friction additives.

The oxidizable phosphorus compound can be of the formula $(R)_3P$ where R=H, hydroxy, hydrocarbyl, alkoxy, or aryl. A preferred oxidizable phosphorus compound is dibutyl hydrogen phosphite. By "at least partially oxidized" herein is meant oxidation sufficient to yield a final product with little or no noticeable odor. The oxidizable phosphorus compound is preferably substantially oxidized and more preferably essentially fully oxidized.

In addition to the polysulfides above, compounds that can generate odor if combined with oxidizable phosphorus compounds can include, for example:

Dialkyl or diaryl or mixed symmetrical and unsymmetrical polysulfides: $R'—S_x—R$, where x is greater than I and less than 6. Specific examples of interest include di-tert-butyl-polysulfide, mono- or bis-alkyldithio-1,3,4-dithiadiazole, dibenzyl di- and trisulfides.

Alkylthiuram polysulfides: $R_2NC(S)S_x(S)CNR_2$, where x is greater than 0 and less than 5 and R is alkyl, aryl or part of a heterocyclic ring that incorporates N atom linked to thiocarbonyl group. Specific examples include: tetrabutylthiuram trisulfide, and dipentamethylene thiuram tetrasulfide.

N,N'-Dithiobisamines: $R_2N—S_2—NR_2$, where R can be alkyl or aryl or form part of a heterocyclic moiety that incorporates N attached to S. Specific examples include: N,N'-dithiobis(phthalimide); N,N'-dithiobis(morpholine); N,N'-dithiobis(imidazole).

Dialkyl(aryl)trithiocarbonates: RS—C(S)—SR, where R can be alkyl or hydrocarbyl.

In another embodiment, the present invention provides a lubricant composition with very low, or no odor made by the process of combining a phosphite compound and an alkylamine with a source of sulfur followed by the addition of a polysulfide.

COMPARATIVE EXAMPLE 1

(No presulfurization)

3.3 grams of dibutyl hydrogen phosphite were reacted with 5.0 grams $C_{16-18}$ alkylamine in the presence of 33 grams of t-butyl polysulfide. The polysulfide was added to a 100 mL 3-neck flask fitted with a stirrer, a nitrogen purge, thermometer, and vent connected to a bleach scrubber for $H_2S$ off gas generated. The amine addition rate controls the reaction temperature. The nitrogen blanket was fitted after the amine charge to the reaction flask. The stirred mixture was heated to 50–100 C (preferably 60–70° C. for 1 hour). The phosphite was not completely converted to the thiophosphate amine salt (58 δ in $^{31}P$ NMR spectra) and residual phosphite was observed at 7 δ in the $^{31}P$ NMR spectra. A strong odor was generated with this reaction mixture.

INVENTIVE EXAMPLE 2

17.5 grams of dibutyl hydrogen phosphite were reacted with 25 grams $C_{16-18}$ alkylamine and 2.5 grams sulfur. The dibutyl hydrogen phosphite and sulfur were added to a 100 mL 3-neck flask fitted with a stirrer, a nitrogen purge, thermometer, and vent connected to a bleach scrubber for $H_2S$ off gas generated. The amine addition rate controls the reaction temperature. The nitrogen blanket was fitted after the amine charge to the reaction flask. The reaction product was heated to 50–100° C. (preferably 60–70° C.) until the sulfur dissolves and the phosphite was converted to the thiophosphate amine salt (at 58 δ in $^{31}P$ NMR spectra). No phosphite was seen at 7 δ in the $^{31}P$ NMR spectra. 33 grams of t-butyl polysulfide was then mixed with 8.8 g of the above product and stirred for 1 hour at 60° C. There was no foul odor generated with this mixture.

INVENTIVE EXAMPLE 3

3.3 grams of dibutyl hydrogen phosphite are reacted with 5.0 grams of $C_{16-18}$ alkylamine and 17 grams of sulfurized isobutylene. Dibutyl hydrogen phosphite and sulfurized isobutylene was added to a 100 mL 3-neck flask fitted with a stirrer, a nitrogen purge, thermometer, and vent connected to a bleach scrubber for $H_2S$ off gas generated. The amine addition rate controls the reaction temperature. The nitrogen blanket was fitted after the amine charge to the reaction flask. The stirred mixture was heated to 50–100° C. (preferably 60–70° C.) and stirred until the phosphite was completely reacted (58 δ in $^{31}$P NMR spectra and no 7 δ in the $^{31}$P NMR spectra). 16 grams of t-butyl polysulfide was added to the resultant product and stirred for 1 hour at 60° C. There was no foul odor generated with this mixture.

COMPARATIVE EXAMPLE 4

(DBHP "spike" added)

12 grams of dibutyl hydrogen phosphite was reacted with 25 grams $C_{16-18}$ alkylamine and 2.5 grams sulfur. The dibutyl hydrogen phosphite and sulfur were added to a 100 mL 3-neck flask fitted with a stirrer, a nitrogen purge, thermometer, and vent connected to a bleach scrubber for $H_2S$ off gas generated. The amine addition rate controls the reaction temperature. The nitrogen blanket was fitted after the amine charge to the reaction flask. The reaction product was heated to 50–100° C. (preferably 60–70° C.) until the sulfur dissolves and the phosphite was converted to the thiophosphate amine salt (at 58 δ in $^{31}$P NMR spectra). No phosphite was present at 7 δ in $^{31}$P NMR spectra. 33 grams of t-butyl polysulfide and 1 grams of dibutyl hydrogen phosphite was reacted with 7.8 g of the above product and stirred for 1 hour at 60° C. A strong odor was generated with this reaction mixture.

COMPARATIVE EXAMPLE 5

5.74 grams of tritolyl phosphite were reacted with 1.85 grams triethylamine in the presence of 33 grams of t-butyl polysulfide. The phosphite and polysulfide were added to a 100 mL 3-neck flask fitted with a stirrer, a nitrogen purge, thermometer, and vent connected to a bleach scrubber for $H_2S$ off gas generated. The amine addition rate controls the reaction temperature. The nitrogen blanket was fitted after the amine charge to the reaction flask. The stirred mixture was heated to 50–100° C. (preferably 50–60° C. for 1 hour). The phosphite was not completely converted to the thiophosphate amine salt (58 δ in $^{31}$P NMR spectra) and residual phosphite was observed at 127 δ in the $^{31}$P NMR spectra. A strong odor was generated with this reaction mixture.

INVENTIVE EXAMPLE 6

57.4 grams of tritolyl phosphite were reacted with 18.5 grams triethylamine and 5 grams sulfur. The tritolyl phosphite and sulfur were added to a 100 mL 3-neck flask fitted with a stirrer, a nitrogen purge, thermometer, and vent connected to a bleach scrubber for $H_2S$ off gas generated. The amine addition rate controls the reaction temperature. The nitrogen blanket was fitted after the amine charge to the reaction flask. The reaction product was heated to 50–100° C. (preferably 70–80° C.) until the sulfur dissolves and the phosphite was converted to the thiophosphate amine salt (at 58 δ in $^{31}$P NMR spectra). No phosphite was seen at 127 δ in the $^{31}$P NMR spectra. 33 grams of t-butyl polysulfide was then mixed with 8.09 g of the above product and stirred for 1 hour at 60° C. There was no foul odor generated with this mixture.

COMPARATIVE EXAMPLE 7

3.3 grams of dibutyl hydrogen phosphite were reacted with 1.37 grams diethylamine in the presence of 33 grams of t-butyl polysulfide. The phosphite and polysulfide were added to a 100 mL 3-neck flask fitted with a stirrer, a nitrogen purge, thermometer, and vent connected to a bleach scrubber for $H_2S$ off gas generated. The amine addition rate controls the reaction temperature. The nitrogen blanket was fitted after the amine charge to the reaction flask. The stirred mixture was heated to 50–100° C. (preferably 50–60° C. for 1 hour). The phosphite was not completely converted to the thiophosphate amine salt (58 δ in $^{31}$P NMR spectra) and residual phosphite was observed at 7 δ in the $^{31}$P NMR spectra. A strong odor was generated with this reaction mixture.

INVENTIVE EXAMPLE 8

33 grams of dibutyl hydrogen phosphite were reacted with 13.7 grams diethylamine and 5.0 grams sulfur. Dibutyl hydrogen phosphite and sulfur were added to a 100 mL 3-neck flask fitted with a stirrer, a nitrogen purge, thermometer, and vent connected to a bleach scrubber for $H_2S$ off gas generated. The amine addition rate controls the reaction temperature. The nitrogen blanket was fitted after the amine charge to the reaction flask. The reaction product was heated to 50–100° C. (preferably 70–75° C.) until the sulfur dissolves and the phosphite was converted to the thiophosphate amine salt (at 58 δ in 31P NMR spectra). No phosphite was seen at 7 δ in the $^{31}$P NMR spectra. 33 grams of t-butyl polysulfide was then mixed with 5.17 g of the above product and stirred for 1 hour at 60° C. There was no foul odor generated with this mixture.

COMPARATIVE EXAMPLE 9

4.74 grams of triphenyl phosphine were reacted with 5 grams $C_{16-18}$ amine in the presence of 33 grams of t-butyl polysulfide. The phosphine and polysulfide were added to a 100 mL 3-neck flask fitted with a stirrer, a nitrogen purge, thermometer, and vent connected to a bleach scrubber for $H_2S$ off gas generated. The amine addition rate controls the reaction temperature. The nitrogen blanket was fitted after the amine charge to the reaction flask. The stirred mixture was heated to 50–100° C. (preferably 70–85° C. for 1 hour). The phosphine was not completely converted to the phosphine sulfide amine salt (43 δ in $^{31}$P NMR spectra) and residual phosphine was observed at −6 δ in the 31P NMR spectra. A strong odor was generated with this reaction mixture.

INVENTIVE EXAMPLE 10

4.74 grams of triphenyl phosphine sulfide were reacted with 5.0 grams $C_{16-18}$ amine in the presence of 33 grams of t-butyl polysulfide. The phosphine and polysulfide were added to a 100 mL 3-neck flask fitted with a stirrer, a nitrogen purge, thermometer, and vent connected to a bleach scrubber for $H_2S$ off gas generated. The amine addition rate controls the reaction temperature. The nitrogen blanket was fitted after the amine charge to the reaction flask. The reaction product was heated to 90–100° C. until the triphenyl phosphine sulfide dissolves and the mixture heated for 1 hour at 60° C. There was no foul odor generated with this mixture.

TABLE I

Total mercaptan levels detected on comparative and inventive examples

| Example | Reactants | $^{31}$Pnmr * (major) | Total mercaptan (ppm) † |
|---|---|---|---|
| Example 1 | DBHP/Amine/Polysulfide | 58δ, 7δ, 0δ | >140 ppm |
| Example 2 | DBHP/Amine/Sulfur | 58δ | 2 ppm |

TABLE I-continued

Total mercaptan levels detected on comparative and inventive examples

| Example | Reactants | $^{31}$Pnmr * (major) | Total mercaptan (ppm) † |
|---|---|---|---|
| | reaction + Polysulfide | | |
| Example 3 | DBHP/Amine/SIB reaction + polysulfide | 58δ | 5 ppm |
| Example 4 | Example 2 reaction + DBHP spike + polysulfide | 58δ, 7δ, 0δ | 22 ppm |
| Example 5 | Tritolyl phosphite/TEA/ polysulfide | 127δ(m)58(m)δ 0–(−18)δ | >140 ppm |
| Example 6 | Tritolyl phosphite/TEA/ Sulfur reaction + polysulfide | 127(m)δ, 58(m)δ, 0–(−18)δ | 0 ppm |
| Example 7 | DBHP/DEA/polysulfide | 58δ, 7δ, 0δ | 40 ppm |
| Example 8 | DBHP/DEA/Sulfur reaction + polysulfide | 58δ | 0 ppm |
| Example 9 | TPP/Amine/polysulfide | 42.8δ, 27δ, −6δ | 20 ppm |
| Example 10 | TPPS/Amine reaction + polysulfide | 42.8δ | 0 ppm |
| t-butyl polysulfide | | N/A | 3 ppm |

NOTES:
* NMR ref @ 42.76δ for triphenyl phosphine sulfide
(m) = multiplet for nmr chemical shift
† Detection of total mercaptan using a total mercaptan sensing tube manufactured by Gastec Corporation, Ayase-City, Japan. The tube produces a yellow color stain on palladium sulfate by the following reaction: $2RSH + PdSO_4 \rightarrow (RS)_2Pd + H_2SO_4$ Table I thus shows that Comparative Examples 1, 4, 5, 7 and 9 have unacceptably high total mercaptan ppm levels, whereas Inventive Examples 2, 3, 6, 8 and 10 have very low total mercaptan ppm levels.

Low odor was also demonstrated when the above examples were incorporated into full formulated gear additive concentrate consisting of antiwear extreme pressure additives, rust and corrosion inhibitors, surfactants, antifoam agents and dispersants. As indicated in the comparative examples, odor is generated when an oxidizable phosphorous species is mixed with a gear package containing a reactive sulfur compound and an alkylamine (Example A and B of Table II). Odor is not generated when the gear package containing a non-oxidizable phosphorous compound is pre-mixed with a reactive sulfur source (Example C) before addition of a compound that liberates mercaptan if combined with an oxidizable phosphorus compound.

TABLE II

Total mercaptan detection of formulated gear packages

| Examples | Reaction Mixture | $^{31}$Pnmr * (major) | Total mercaptan (ppm) † |
|---|---|---|---|
| A | DBHP/Amine/Polysulfide in gear additive package | 58δ, 7δ, 0δ | 60 ppm |
| B | DBHP/Amine/SIB reaction + polysulfide in gear additive package | 58δ, 7δ, 0δ | 30 ppm |
| C | DBHP/Amine/Sulfur reaction + polysulfide in gear additive package | 58δ, 0δ | 0 ppm |

NOTES:
* NMR ref @ 42.76δ for triphenyl phosphine sulfide
† Detection of total mercaptan using a total mercaptan sensing tube manufactured by Gastec Corporation, Ayase-City, Japan. The tube produces a yellow color stain on palladium sulfate by the following reaction: $2RSH + PdSO_4 \rightarrow (RS)_2Pd + H_2SO_4$ From the foregoing description, one skilled in the art can easily ascertain the essential characteristics of this invention and, without departing from the spirit and scope thereof, can make various changes and modifications of the invention to adapt it to various usages and conditions.

While the invention has been described in connection with the preferred embodiment, it should be understood readily that the present invention is not limited to the disclosed embodiment. Rather, the present invention is intended to cover various equivalent arrangements and is only limited by the claims which follow:

We claim:

1. A process for preparing a lubricant additive of reduced odor, the process comprising first combining an oxidizable phosphorus compound and an alkylamine with a source of reactive sulfur whereby the oxidizable phosphorus compound is at least partially oxidized, followed by the addition of a compound that generates odor if combined with an oxidizable phosphorus compound.

2. The process of claim 1 wherein said oxidizable phosphorus compound is of the formula $(R)_3P$ where R═H, hydroxy, hydrocarbyl alkoxy or aryl.

3. The process of claim 1 wherein said oxidizable phosphorus compound is dibutyl hydrogen phosphite.

4. The process of claim 1 wherein the alkylamine is a primary, secondary or tertiary alkylamine.

5. The process of claim 1 wherein the alkylamine is a $C_8$–$C_{30}$ alkylamine.

6. The process of claim 1 wherein the alkylamine is a $C_{16}$–$C_{18}$ alkylamine.

7. The process of claim 1 wherein the alkylamine is a tertiary aliphatic primary amine or a salt thereof.

8. The process of claim 1 wherein said source of sulfur is elemental sulfur.

9. The process of claim 1 wherein said source of sulfur is sulfurized olefin.

10. The process of claim 1 wherein the compound that generates odor is selected from the group consisting of t-butyl polysulfide, dialkyl polysulfide or diaryl polysulfide, alkylthiuram polysulfides, N,N'-dithiobisamines, and dialkyl (aryl)trithio-carbonates.

11. A lubricant additive prepared according to the process of claim 1.

12. A process for preparing a lubricant additive of reduced odor, the process comprising first reacting a dialkyl hydrogen phosphite compound and a $C_{16-18}$ alkylamine with a source of reactive sulfur followed by the addition of a polysulfide.

13. The process of claim 12 wherein said dialkyl hydrogen phosphite is dibutyl hydrogen phosphite.

14. The process of claim 12 wherein said source of sulfur is elemental sulfur.

15. The process of claim 12 wherein said source of sulfur is sulfurized isobutylene.

16. The process of claim 12 wherein said polysulfide is t-butyl polysulfide.

17. A lubricant additive prepared according to the process of claim 12.

18. A lubricant comprising the lubricant additive of claim 11.

19. A lubricant comprising the lubricant additive of claim 17.

* * * * *